United States Patent [19]

Lighton et al.

[11] Patent Number: 4,494,438

[45] Date of Patent: Jan. 22, 1985

[54] AIR-TO-AIR WEAPON MODIFICATION FOR MILITARY AIRCRAFT

[76] Inventors: Gary R. Lighton, P.O. Box 81, Nedrow, N.Y. 13120; Michael S. Lighton, 4600 Odell Pl., Jamesville, N.Y. 13078

[21] Appl. No.: 459,295

[22] Filed: Jan. 20, 1983

[51] Int. Cl.[3] ..... F41F 3/06; F41F 5/02

[52] U.S. Cl. ..... 89/1.813; 89/1.819; 89/1.56; 244/137 R

[58] Field of Search ..... 89/1.5 E, 1.5 R, 1.5 J, 89/1.814, 1.813, 1.812, 1.819; 244/137 A

[56] References Cited

U.S. PATENT DOCUMENTS

| | | | |
|---|---|---|---|
| 3,306,208 | 2/1967 | Bergey et al. | 89/1.5 R X |
| 3,499,363 | 3/1970 | Lauro | 89/1.5 R |
| 3,598,015 | 10/1971 | Delistovich et al. | 89/1.5 E X |
| 3,735,668 | 5/1973 | Langlois et al. | 89/1.814 |
| 3,779,129 | 12/1973 | Lauro | 89/1.5 E |
| 3,803,974 | 4/1974 | Everest et al. | 89/1.5 E |
| 4,359,926 | 11/1982 | Sano et al. | 89/1.814 |
| 4,412,475 | 11/1983 | Hornby | 89/1.816 |
| 4,417,709 | 11/1983 | Fehrm | 244/137 A X |

*Primary Examiner*—David H. Brown

[57] ABSTRACT

An existing, conventional fighter aircraft equipped with an air-to-ground weapons system is provided, through the present invention, with means for additionally carrying and releasing air-to-air missiles. A mounting member having a conventional air-to-air missile launcher attached to each side is provided with a pair of spaced lugs for engagement by the existing hooks on one or more of the aircraft pylons normally used for attachment of air-to-ground weapons. A pilot-controlled switch is selectively positioned to connect either the air-to-air or air-to-ground weapons systems with the existing weapons control network for operation upon actuation of the standard "fire", "uncage" or "reject" switches. Relay means associated with the launcher mounted member intitially connect a first of the two missiles carried thereby with the control network and, after actuation of either the fire or reject switch, automatically connect the second of the two missiles with such switches. Preferably, mounting members for the air-to-air weapons may be carried upon either of two pylons, one on each wing, and an additional switch is selectively positioned prior to take-off to control which of the two pylon stations will be connected to the weapons release network upon actuation of the pilot-control switch to select the air-to-air mode.

7 Claims, 10 Drawing Figures

PYLON STATIONS

ELECTRICAL INTERFACE UNIT
INTERSTATION CONTROL UNIT
ARMAMENT CIRCUIT BREAKER PANE
ARMAMENT CONTROL PANEL
LEFT
OFF
RIGHT
PWR
SSI
SSII

| FIG. 4a | FIG. 4b |
|---|---|

AIR-TO-AIR WEAPON MODIFICATION FOR MILITARY AIRCRAFT

BACKGROUND OF THE INVENTION

The present invention relates to weapons systems for military fighter aircraft, and more specifically to a system for equipping an existing aircraft having only air-to-ground weapons capability with an air-to-air weapons system.

Modern fighter aircraft utilize very extensive and sophisticated electronic packages for controlling the weapons systems. Such aircraft are designed, built and equipped to utilize particular types of weapons, i.e., air-to-ground and/or air-to-air, but the size and complexity of the electronics equipment has generally made modification of an existing system to employ weapons other than those with which the aircraft is originally designed to operate impractical.

It is a principal object of the present invention to provide an effective and practical system for modifying an existing military fighter aircraft equipped to employ only air-to-ground weapons to add the capability of carrying and launching air-to-air weapons.

A further object is to provide a novel combination of hardware and circuitry for incorporation with an existing military aircraft to expand the weapons capabilities thereof.

Another object is to provide means for mounting a pair of air-to-air missile launchers at a position on a military aircraft designed for suspension-type mounting of air-to-ground weapons.

A still further object is to provide means for carrying air-to-air weapons on an existing military aircraft equipped with an air-to-ground weapons system, together with supplementary electronic equipment for integration with the weapons system electronics to control the deployment of said air-to-air weapons.

Still another object is to provide a military aircraft with the capability of carrying and deploying air-to-air missiles by utilizing existing aircraft wiring for two purposes through electrical means effective upon pilot command to disconnect the wiring from its original point of origin and reconnect it to an auxiliary point of origin.

An additional object is to provide a suspension-type mounting system for air-to-air missiles which may be selectively attached to and detached from the bomb rack hooks on a wing pylon of a conventional military fighter aircraft.

Other objects will in part be obvious and will in part appear hereinafter.

SUMMARY OF THE INVENTION

In accordance with the foregoing objects, the invention includes mounting means, preferably in the form of a box-like enclosure having a pair of spaced lugs for engagement by the hooks which are provided on an existing military aircraft pylon to carry bombs or other air-to-ground weapons. A pair of conventional air-to-air missile launchers are affixed to opposite sides of the mounting member and relay means within the enclosure sequentially connect the missiles with the aircraft electrical system for operation thereby.

In the disclosed embodiment, the launcher mounting member may be carried on either of the outermost pylons on each wing. A so-called left-right select switch is installed in the existing armament circuit breaker panel for selective setting to communicate power to the pylon station on the wing carrying air-to-air missiles (if any) for the particular mission. The setting of this switch is performed by the ground crew since the armament circuit breaker panel is normally in a position which is inaccessible to the pilot during flight.

The aircraft may carry air-to-ground weapons on some or all of the remaining pylon stations, i.e., those not equipped for mounting of the air-to-air missiles. A pilot-operated, air/ground mode select switch is installed on the existing armament control panel for selective setting to communicate power either to the air-to-ground weapons system or the air-to-air missiles upon actuation by the existing weapons control network. The individual, existing, station select switches on the armament control panel are actuated in the usual manner to ready the weapons at the desired pylon station for deployment. Both the left/right select switch and the air/ground select switch are connected to respective relays in an electrical interface unit which is installed on the aircraft as part of the present invention. Power is communicated to the selected pylon station through these relays.

When only one missile is loaded on the mounting means, the aforementioned relay means carried in the enclosure of the missile mounting means operate to communicate power to the loaded missile upon pilot command. When missiles are loaded on both launchers at the station readied for weapons release, the relay means operates to communicate power to a first of the missiles upon pilot actuation of the "fire" button on the aircraft stick grip, or the "reject" button on the throttle grip. Upon the first actuation of either of the "fire" or "reject" buttons the relay means operate automatically to communicate power to the second missile upon the next actuation of either button. Ripple inhibit means are included in the relay means to prevent actuation of both missiles with only a single actuation of the "fire" or "reject" buttons.

DETAILED DESCRIPTION

Figure 1:
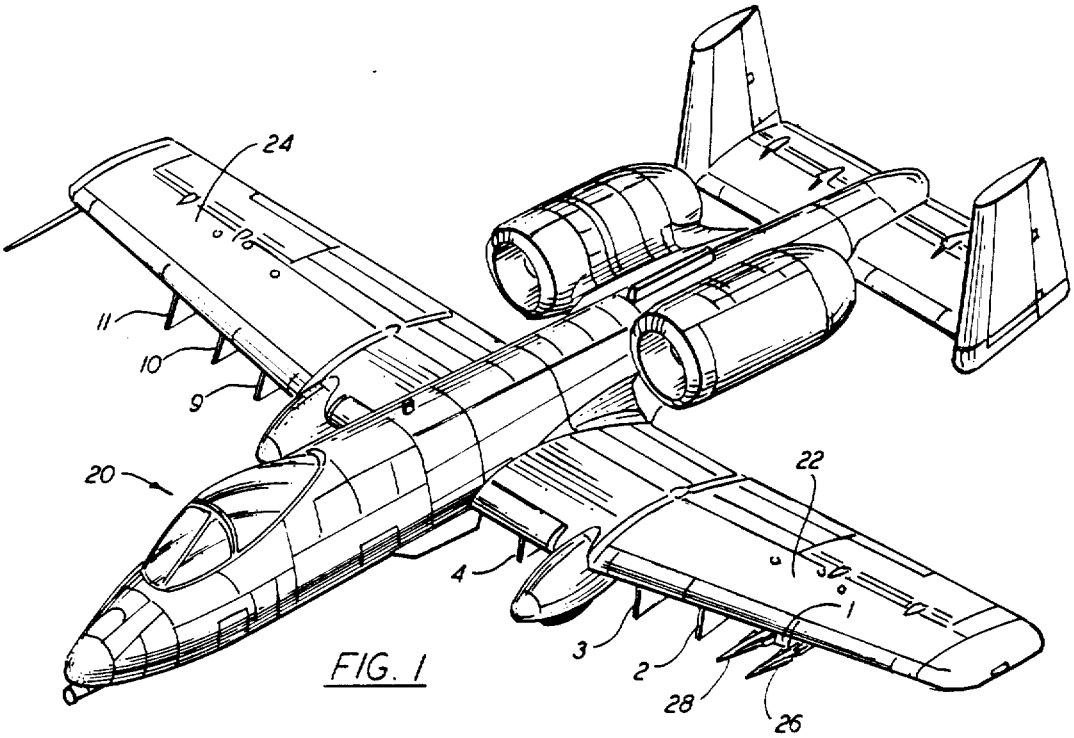
FIG. 1 is a perspective view of a typical aircraft of the type wherein the present invention is incorporated.

Referring now to the drawings, reference numeral 20 denotes generally an aircraft of the military fighter type, having a plurality of pylons for carrying weapons of various types to be deployed from the aircraft. For purposes of illustration, aircraft 20 is shown and described as being of the type currently in use by the U.S. Air Force and designated the A-10. These aircraft have a total of eleven weapons-carrying pylons beneath the wings and fuselage at stations designated 1–11, from the outermost pylon on the left wing to the outermost on the right. The same numbering is employed in the present drawings to designate the pylon stations extending from station 1 on wing 22 to station 11 on wing 24.

Aircraft 20 is of a type designed and equipped to carry air-to-ground weapons at pylon stations 1–11 by the usual suspension-type mounting means, namely, a pair of spaced hooks on the bottom of each pylon which engage lugs on the bomb racks or other such air-to-ground weapon mounting means. Aircraft which are designed to carry air-to-air missiles, on the other hand, have missile launchers mounted directly upon (affixed to) the pylons which are hollow structures, connected to the undersides of the wings and/or fuselage, containing the necessary power transfer and control circuitry for deploying such missiles. Thus, it is normally not contemplated that aircraft such as the A-10 will carry air-to-air weapons since extensive retrofitting of the electronic system would be required in addition to the mounting of launchers on pylons not originally designed for such mounting. There is also the possibility that the pilot could inadvertently release an air-to-air missile at a ground target or an air-to-ground missile at an air target, with obviously undesirable consequences.

Figure 1A:
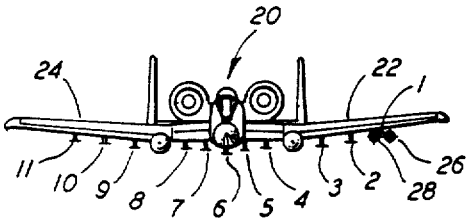
FIG. 1*a* is a front elevational view of the aircraft of FIG. 1, on a smaller scale.
Figure 2:
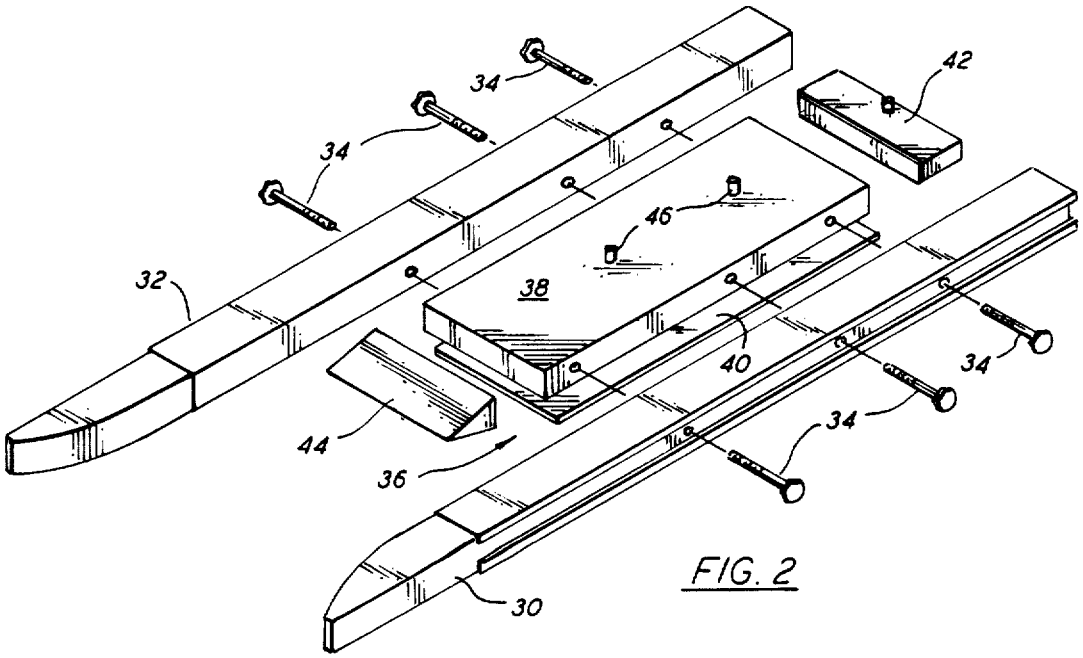
FIG. 2 is an exploded perspective view of a mounting unit employed in the invention, showing a pair of conventional missile launchers for connection thereto.

The present invention provides relatively simple and expedient means for adapting air-to-air missile launchers to suspension-type mounting, in the nature of air-to-ground weapons mounting, and for interfacing existing aircraft electronic circuitry to control the deployment of missiles from such launchers. A pair of conventional air-to-air missiles 26 and 28, such as Air Force AIM-9 missiles, are seen in FIGS. 1 and 1*a*, mounted at pylon station 1 of aircraft 20. The mounting means for the missiles is shown in exploded perspective in FIG. 2, wherein a pair of conventional missile launchers 30 and 32 designed to carry and launch missiles such as 26 and 28 (e.g., AERO-3B or LAU-114 launchers) are connected by bolts 34 to a mounting member in the form of a flat, box-like enclosure designated generally by reference numeral 36. Enclosure 36 preferably comprises a milled-out aluminum block 38, forming a hollow body to contain electrical elements described later, bottom cover 40, rear cover and fairing 42 and forward fairing 44. On the top of block 38 are a pair of spaced, pivotal lugs 46 for engagement by the two bomb rack hooks normally employed for suspension of air-to-ground weapons from the bottom of such aircraft pylons.

Thus, missiles 26 and 28 are carried at pylon station 1 by being loaded on launchers 30 and 32, which are affixed to mounting member 36, the latter being suspended by lugs 46 from the bomb rack hooks (not shown) at pylon station 1. In the disclosed embodiment, the present invention adapts aircraft 20 for the mounting of air-to-air missiles at either of pylon stations 1 or 11, the outermost left and right stations. Although the missile mounting member, whether at station 1 or 11, may carry either one or two missiles, only one of the two stations may carry and deploy missiles on a given flight mission.

Figure 3:
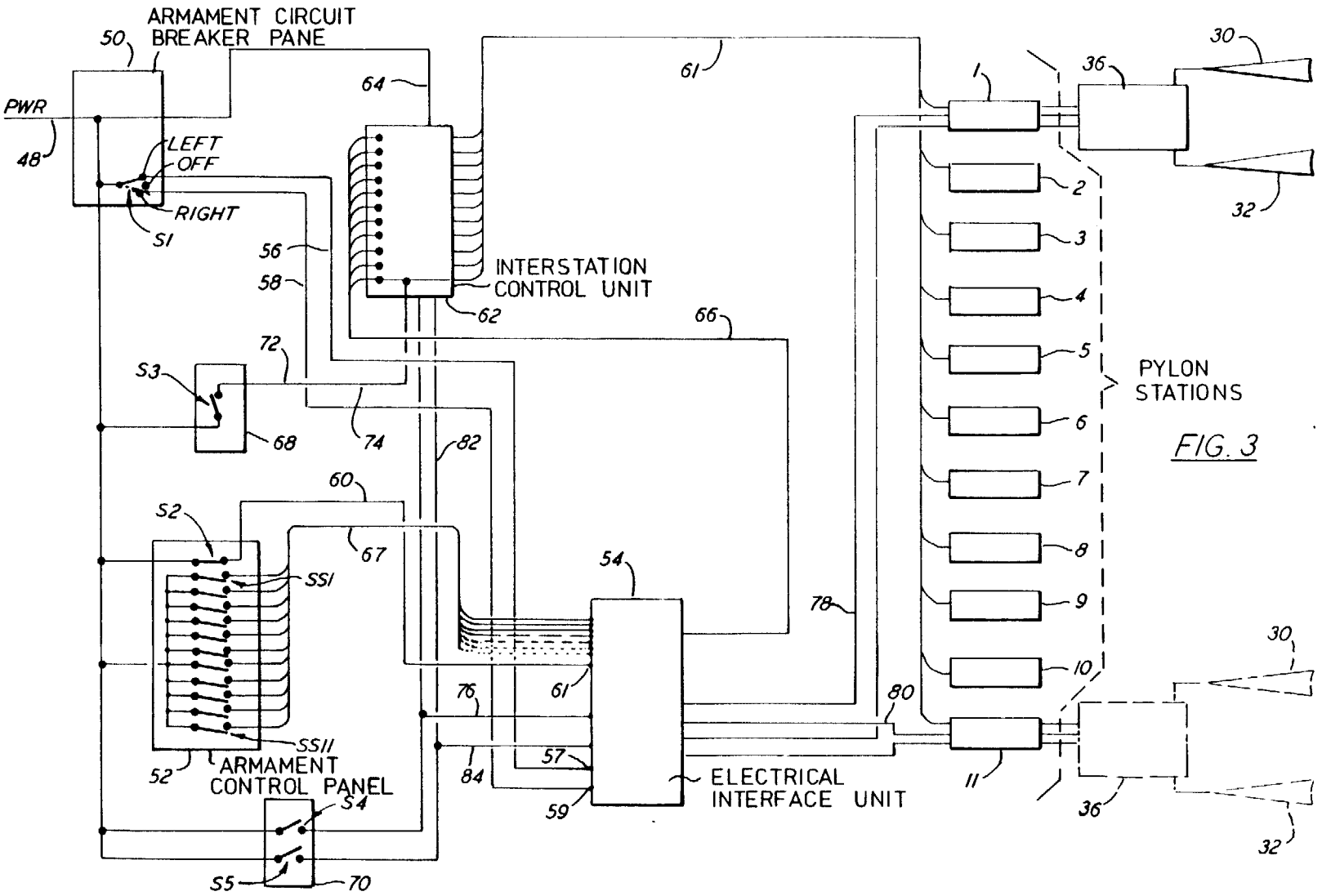
FIG. 3 is a schematic block diagram showing the general interconnection of various conventional portions of the aircraft electrical system with elements of the present invention interfaced therewith.

Turning now to FIG. 3, general features of the overall electrical system for weapons control are shown schematically. The power supply is provided on line 48, which actually would comprise a number of lines carrying both AC and DC electrical power at a number of voltage levels, to armament circuit-breaker panel 50 which is conventional in all respects except for the addition of left/right select switch S1. This switch is installed as part of the present invention for setting by the ground crew prior to take-off, since the armament circuit-breaker panel is in a position not accessible to the pilot during flight. Although the switch could be mounted in other locations, the armament circuit-breaker panel in the A-10 aircraft provides a convenient place and, in any case, there is never a requirement to change the position of the switch during flight. Switch S1 may be placed in any of three discrete positions, designated "left", "off" and "right", the functions of which will be explained later.

A second switch added as a modification to an existing aircraft electrical unit is switch S2, which is installed in armament control panel 52. The latter contains the usual station select switches for individual, selective actuation by the pilot to connect the weapons carried at one of the pylon stations 1–11 with the necessary power and control circuitry so that the weapons will respond to "fire", "reject" and "uncage" signals. The station select switches for the respective pylon weapons stations, which are present in armament control panel 52 irrespective of the present invention, are designated SS1 through SS11, only the first and last reference numerals being included on FIG. 3 for greater clarity.

The purpose of switch S1, as previously mentioned, is to permit connection of the proper one of the two pylon stations at which air-to-air missiles may be carried, with the necessary power and control circuitry for deploying the missiles. That is, when air-to-air missiles are carried at station 1 (left wing), switch S1 is placed in a first position, and when at station 11 (right wing) in a second position. Switch S2 is operable by the pilot, being placed in a first position in preparation for deployment of the air-to-air missiles and in a second position for utilizing the air-to-ground weapons systems. For example, if S1 is set in its first ("left") position, as it is when air-to-air missiles are carried at station 1, placing S2 in its first position permits "call-up" of the air-to-air weapons by actuation of SS1, and placing S2 in its second position permits call-up of the air-to-ground weapons at any of stations 2–11 by actuation of the corresponding station select switch (SS2–SS11).

The functions of switches S1 and S2 are implemented by groups of relays in an electrical interface unit, denoted generally by reference numeral 54, and added to the weapons control circuitry as part of the present invention. Power from line 48 (i.e., from the aircraft power supply) is connected through line 56 to input terminal 57 of interface unit 54 when switch S1 is in its first or left-select position, (as shown in solid lines) and through line 58 with another input terminal 59 when S1 is in the second or right select (dotted line) position. Power from line 48 is connected through line 60 to input terminal 61 in interface unit 54 when switch S2 is closed (in its first or air-to-air mode position), thereby actuating a group of relays which are deactuated when S2 is open (in its second or air-to-ground mode position). The effect of actuating and deactuating the various relays of interface unit 54 by operation of switches S1 and S2 will be explained later with reference to FIG. 4 which illustrate all pertinent details of the circuitry of interface unit 54.

Still referring to FIG. 3, the circuits at each of pylon stations 1–11 which receive and respond to the electrical signals associated with operation of the missiles are connected by individual lines, indicated collectively at 61, to the existing (i.e., not part of or modified by the present invention) aircraft interstation control unit 62. Line 64 provides the appropriate power inputs from circuit-breaker panel 50, and line 66 the station ready signals, responsive to actuation of station select switches SS1–SS11, to interstation control unit 62. The station ready or "call-up" signals, rather than being connected directly from armament control panel 52 to interstation control unit 62, both standard units of weapons control circuitry in such military aircraft as the A-10, are connected through interface unit 54. Lines from each of station select switches SS1–SS11 are connected to individual input terminals of interface unit 54, as will be shown in FIG. 4, the lines being collectively indicated in FIG. 3 by reference numeral 67.

Switch S3 represents the "fire" button conventionally provided on the aircraft stick grip, diagrammatically indicated by reference numeral 68; switches S4 and S5 correspond to the "uncage" and "reject" buttons on throttle grip 70. Closure of switch S3 provides power through line 72 to unit 62, the internal circuitry of which operates in known fashion to transmit signal which fires a weapon at the station preselected by prior actuation of the appropriate station select switch. A signal which operates to uncage the gyro control of weapons so equipped is transmitted in response to closure of switch S4, providing power to unit 62 through line 74 and to interface unit 54 through line 76. When S2 is in the air-to-ground mode and one of the air-to-ground stations requiring an "uncage" signal (only stations 3,4,8 and 9 in the A-10 aircraft) has been readied by actuation of its station select switch, the "uncage" signal will be transmitted to the proper weapon upon application of power through line 74 to unit 52. When S2 is in the air-to-air mode and the station select switch has been actuated for the station (1 or 11) carrying the air-to-air missile(s) the uncage signal is provided directly (i.e., not to unit 62) through line 76, interface unit 54 and line 78 or 80 to station 1 or 11, respectively. Likewise, closure of switch S5 provides signals to reject a missile which is otherwise ready for firing through line 82 to unit 62, in the case of air-to-ground weapons, and through line 84 to interface unit 54 and thereby through lines 86 or 88 to stations 1 or 11, respectively, for air-to-air missiles. The air-to-air missile adapter unit and launchers are shown in FIG. 3 diagrammatically at station 1 in solid lines and at station 11 in dot-dash lines to indicate the alternate mounting position, the same reference numerals being used to identify the adapter and launchers as in FIG. 2.

Figures 4, 4A:
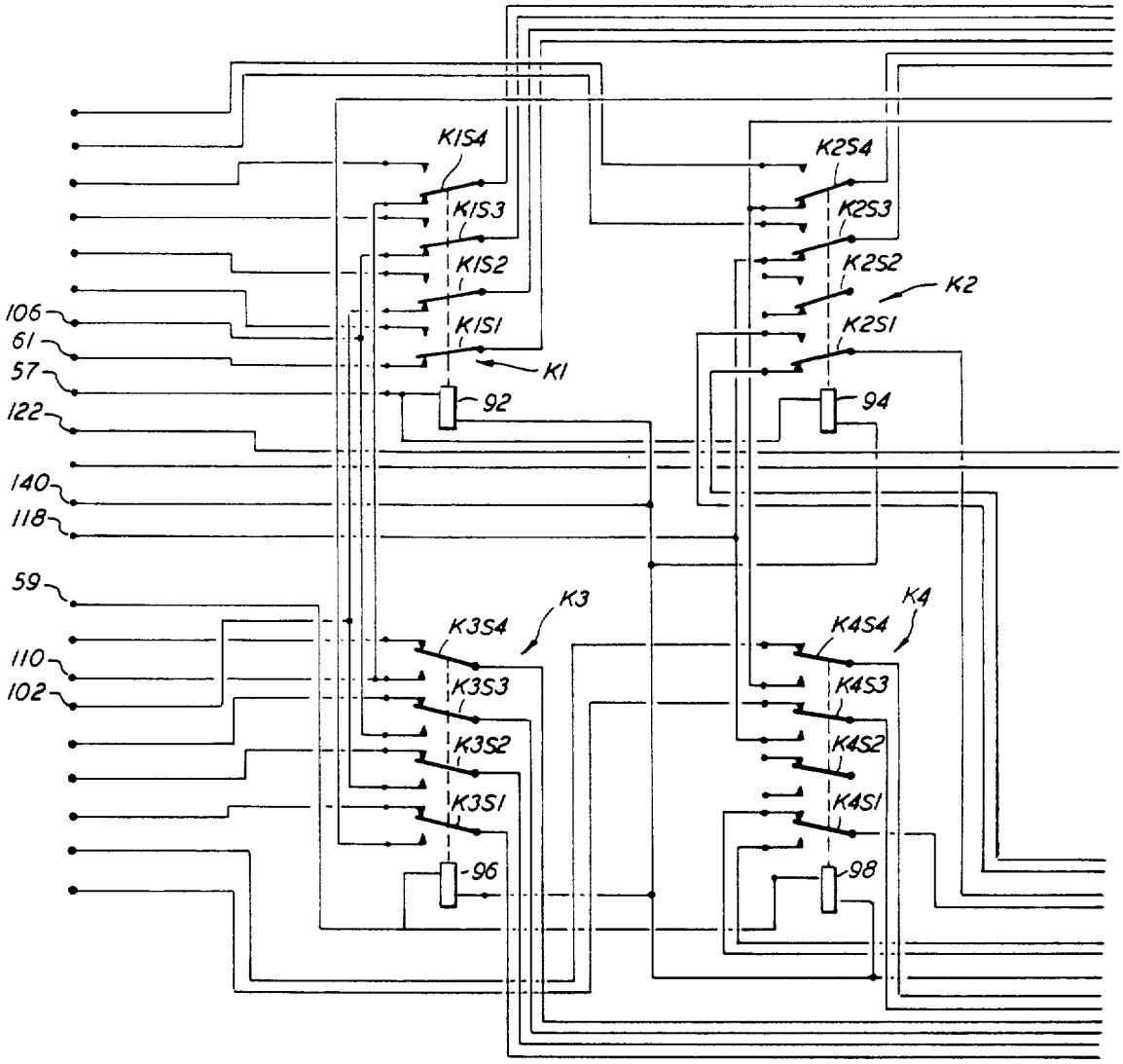
FIG. 4 is arranged on two sheets, 4*a* and 4*b* placed side by side to form one continuous schematic diagram of a first system of relay means forming a part of the invention.
Figure 4B:
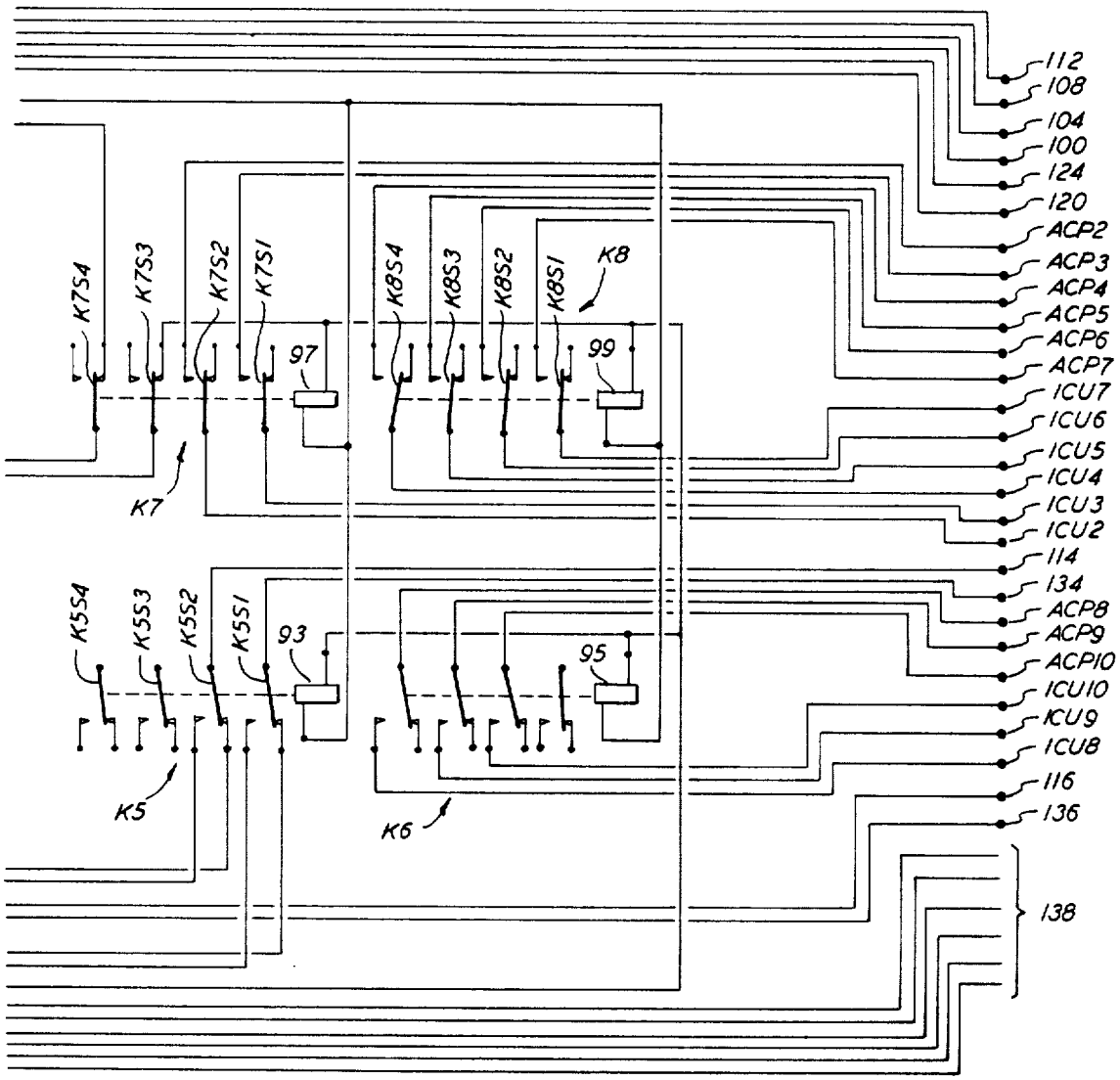

Turning now to the circuit diagram of interface unit 54 shown in FIG. 4, power is supplied to input terminal 57 when left/right select switch S1 is in its first position, thereby energizing coils 92 and 94 of relays K1 and K2, respectively, placing switch contacts of these relays in the positions shown. Placing switch S1 in its second position will remove power from terminal 57, reversing the illustrated positions of the switches of relays K1 and K2 and provide power to input terminal 59, thereby energizing coils 96 and 98 of relays K3 and K4 and likewise reversing the illustrated positions of the switches thereof.

When switch S2 is in the air-to-air mode, coils 93, 95, 97 and 99 of relays K5, K6, K7 and K8, respectively, are all connected to power through input terminal 61 of interface unit 54 and are therefore all actuated, placing the switches of these four relays in the illustrated positions. Placing switch S2 in the open, or air-to-ground mode position, deactuates relays K5–K8 and reverses the illustrated positions of the switches.

The circuit is illustrated in FIG. 4 as it would appear with switch S1 in its first position (air-to-air missiles carried at station 1) and switch S2 in its first position (air-to-air mode). Thus, power is provided at terminals 57 and 61 and relays K1, K2, and K5–K8 are actuated. Relay K1 establishes current paths:

1. through switch K1S1 from terminal 61, which is connected to the incoming power line from armament control panel 52, to terminal 100,
2. through switch K1S2 from terminal 102, which is connected to line 84 (FIG. 3) from switch S5, to terminal 104,
3. through switch K1S3 from terminal 106, which is connected to the aircraft power supply, to terminal 108, and
4. through switch K1S4 from terminal 110, which is connected to line 76 (FIG. 3) from switch S4, to terminal 112.

Each of terminals 100, 104, 108 and 112 is connected to a terminal of the electrical system contained in enclosure 38 of the air-to-air missile adapter carried at pylon station 1, as will be explained in connection with FIG. 5.

Relay K2 establishes current paths:

1. through switch K2S1 from terminal 114, which is connected to the station 1 select switch SS1 in armament control panel 52 (by one of the lines indicated as line 67 in FIG. 3), to terminal 116, which is connected to the station 1 ready line of interstation control unit 62 (by one of the lines indicated as line 66 in FIG. 3), this connection of terminals 114 and 116 also being made through switch K5S2 of actuated relay K5.
2. through switch K2S3 from terminal 118, which is connected to the aircraft power supply, to terminal 120.
3. through switch K2S4 from terminal 122, which is connected to the pilot's headset, through switch K7S4, to terminal 124.

Figure 5B:
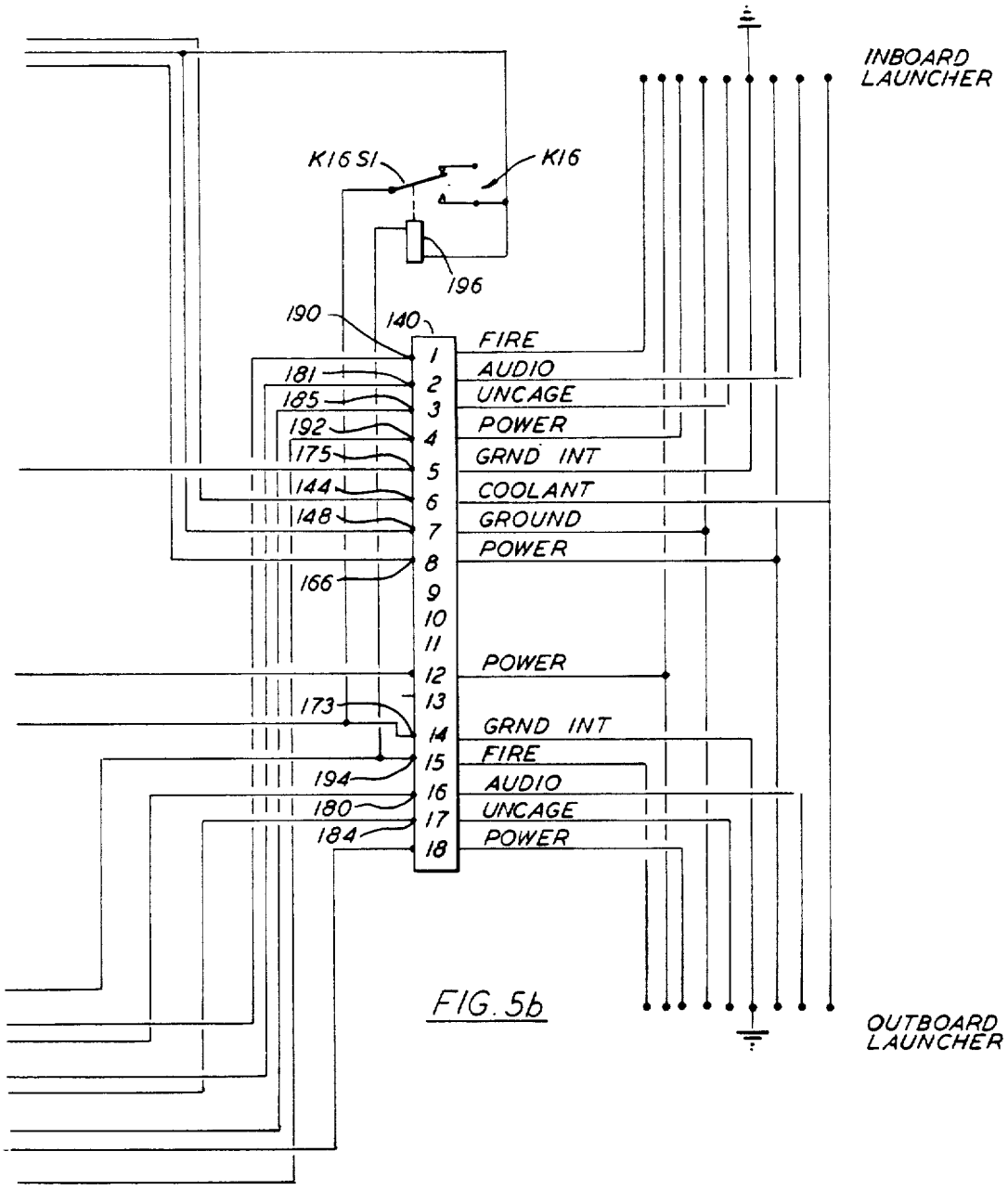
FIG. 5 is arranged on two sheets, 5*a* and 5*b*, placed side by side to form a second continuous electrical schematic diagram of a second system of relay means of the invention.
Figure 5:
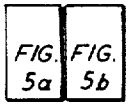
Figure 5A:
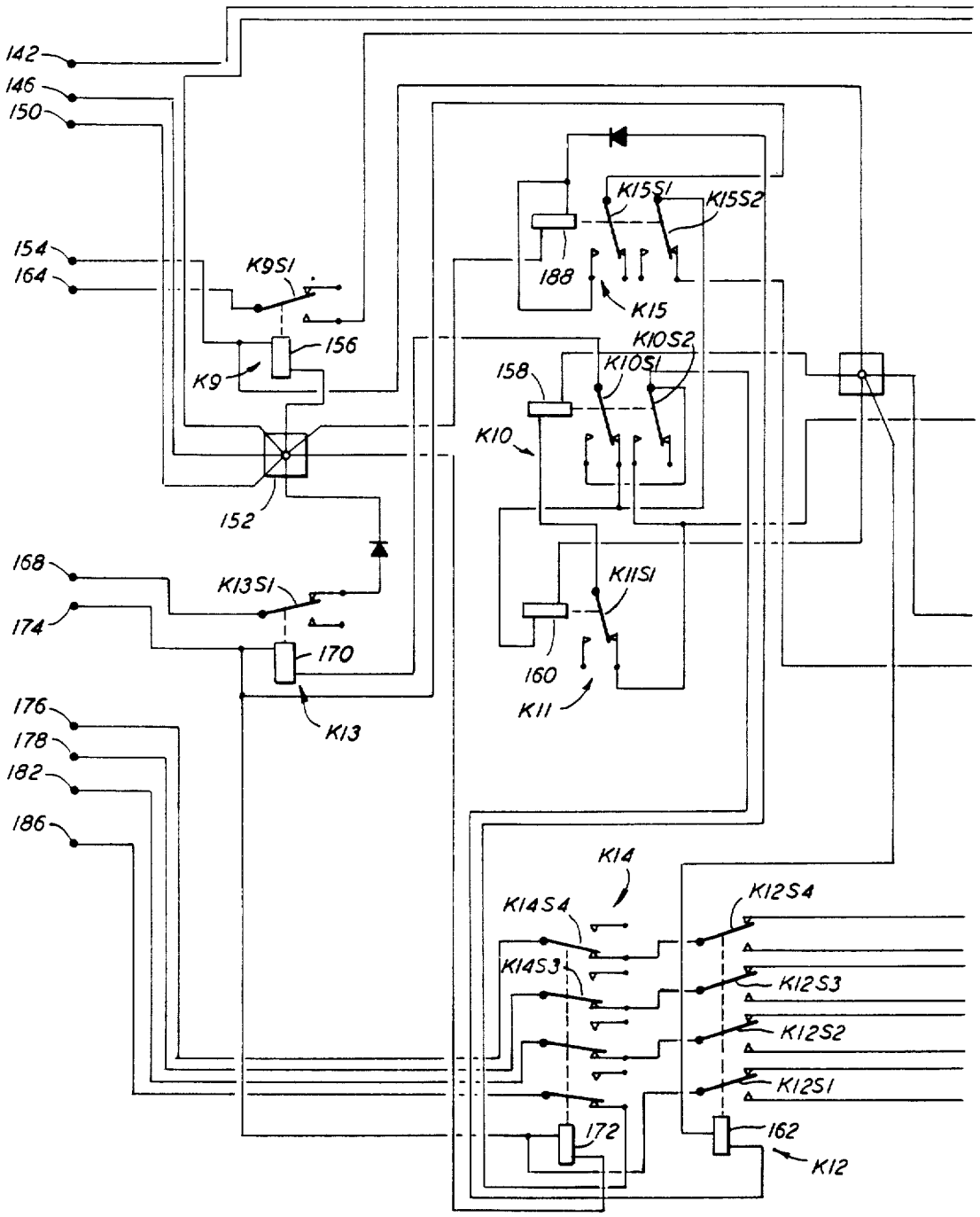

Terminals 120 and 124 are connected to the electrical system of the adapter at station 1, as will be further explained in FIG. 5. Switch K2S2 is not utilized.

Relays K5-K8 function principally to connect station select switches SS1–SS11 of armament control panel 52 with the corresponding station ready lines of interstation control unit 62. In the conventional weapons systems where the aircraft carries only air-to-ground weapons, such connections are made directly. However, when the aircraft is adapted to carry both air-to-air and air-to-ground weapons through the modifications of the present invention it is of critical importance that no air-to-ground weapon be fired when an air-to-air missile is required, and vice versa. This is efficiently prevented by the operation of relays K5–K8 in response to the setting of mode select switch S2.

Placing switch S2 in its first (air-to-air mode) position, as previously explained, provides power to terminal 61 to which all of coils 126, 128, 130 and 132 are connected, thereby actuating all of relays K5–K8. Terminal 134, which is connected to the station 11 select switch SS11 in armament control panel 52, is connected through switch K5S1 to an open contact of switch K4S1 since S1 is in its first (station 1 select) position and relays K3 and K4 are deactuated, as shown. Thus, closure of switch K5S1 is of no consequence in the illustrated positions of the relays. As previously explained in connection with relay K2, terminals 114 and 116 are connected through both of switches K5S2 and K2S1, establishing a current path from station select switch SS1 to the station 1 ready line of unit 62. Therefore, with switches S1 and S2 both in their first positions, placing the relays of interface unit 54 in the positions shown in FIG. 4, the pilot may depress the station 1 select button on armament control panel 52 and an air-to-air missile carried on an adapter at station 1 may be fired or rejected by depressing the "fire" or "reject" buttons.

Switches K5S3, K5S4 and K6S1 are not utilized. All other switches of relays K5–K8 are on open contacts when these relays are actuated whereby the circuits from the station 2–11 select switches on the armament control panel to the corresponding station ready lines in interstation control unit 62 are interrupted and the weapons carried at these stations cannot be readied for deployment by depression of any of switches SS2–SS11. Changing switch S1 from its first (station 1 select) to its second (station 11 select) position, with switch S2 remaining in its first (air-to-air mode) position removes power form terminal 57, deactuating relays K1 and K2, and provides power at terminal 59, actuating relays K3 and K4. The same current paths are then provided through switches K3S1–K3S4 and K4S1–K4S4 with respect to the terminals of the electrical system to an air-to-air missile adapter carried at station 11 as were provided through switches K1S1–K1S4 and K2S1–K2S4 for the electrical system of an adapter at station 1. Terminal 134 is connected to terminal 136 through closed contacts of switches K5S2 and K4S1, thus establishing a current path from station select switch SS11 to the station ready line of unit 62, to which terminal 136 is connected. Therefore, when switch S1 in its second and switch S2 in its first position, the pilot may depress station 11 select switch SS11 and an air-to-air missile carried by an adapter at station 11 will be ready for firing or reject.

Terminals ACP2–ACP10 are connected to armament control panel station select switches SS2–SS10, respectively. Terminals ICU2–ICU10 are connected to the station 2-10 ready lines of interstation control unit 62. The six terminals collectively identified by reference numeral 138 provide the same connections to terminals of the electrical system of an air-to-air missile adapter at station 11 as the upper six terminals provide to an adapter at station 1. A common ground for the coils of all eight relays is provided at terminal 140. It is also to be noted that when switch S1 is in its first position, selecting station 1 as the station having air-to-air mode capability, station 11 is included with the stations having air-to-ground weapons deployment capability; likewise, station 1 may carry air-to-ground weapons and be placed in a ready condition by depressing the SS1 selector button when switch S2 is in the air-to-ground mode position. With switch S1 in its "off" position, power is not provided to either of terminals 57 or 59 and none of relays K1–K4 are actuated, whereby all 11 stations may be utilized for air-to-ground weapons.

Turning now to FIG. 5, connections from the adapter electrical system to the two launchers are made through terminal board 140, the individual lines being labeled with the respective functions of the signals carried thereby, some lines providing signals to an individual launcher and some a common signal to both. Input terminal 142 is connected to terminal 108 and the corresponding one of terminal 138 of interface unit 54 (FIG. 4) and to terminal 144, providing a signal to activate the missile coolant systems at both launcher positions in response to power provided at terminal 106 (FIG. 4). Terminal 146 provides a common chassis ground connecting both missiles to the aircraft ground through terminal 148. Terminal 150 is connected to a common ground terminal 152 and provides a ground signal to a terminal of interstation control unit 62 to indicate that an air-to-air missile adapter is installed at station 1. The ground connection is provided through the same terminal 150 when the adapter is mounted at station 11, but the connection at unit 62 identifies station 11 as the pylon carrying the air-to-air adapter.

Terminal 154 is connected to an incoming aircraft power line and to coils 156, 158, 160 and 162 of relays K9–K12, respectively, thereby providing power to these coils as soon as the aircraft is powered up, although only coil 156 has a ground connection, whereby only relay K9 is actuated at this time. Actuation of relay K9 provides a current path through switch K9S1 from terminal 164, which is connected to an incoming aircraft power line, providing stand-by power to both launchers. Terminal 168 is connected through switch K13S1 of relay K13 to common ground terminal 152 when relay K13 is deactuated, providing a ground connection to the aircraft armament control system indicating that both launchers are empty. Coils 170 172 of relays K13 and K14, respectively, are both connected to terminal 174 which is connected to terminal 100 (FIG. 4) and receives power when switch S2 is in its first (air-to-air mode) position. Thus, relay K14 is actuated whenever switch S2 is in the air mode position, and relay K13 will be actuated when coil 170 is connected to ground at either of terminals 173 or 175.

Terminal 176 is connected to interstation control unit 62 and receives power in response to pilot actuation of "fire" switch S3. Terminal 178 connects terminal 124 (and the corresponding station 11 terminal) of interface unit 54, through switch K13S3 of relay K13 to switch K12S3. When relay K12 is deactuated, as shown, a current path is provided to terminal 180, providing an audio signal in conventional fashion to the pilot's headset when the missile at the outboard launcher has target acquision and is therefore ready for firing. When relay K12 is actuated, in the manner explained later, the current path for the audio signal is through switch K12S3 to terminal 181 of the inboard launcher.

Terminal 182 connects terminal 112 (and the corresponding station 11 terminal) of unit 54, through switch K14S2 to switch K12S2. When relay K12 is deactuated, a current path is provided to terminal 184 of the outboard launcher, providing an uncage signal to the missile at this position in response to pilot actuation of switch S4. When relay K12 is actuated, the uncage signal is provided to terminal 185 of the inboard launcher.

Terminal 186 connects terminal 104 (and the corresponding station 11 terminal) of interface unit 54, through switch K14S1 to coil 188 of relay K15, whereby relay K15 is actuated in response to closing of reject switch S4. Switch K15S1 provides a current path from terminal 174 to coil 188, whereby relay K15 remains actuated after the reject button is released, removing the power to coil 188 from terminal 186. Also, when relay K15 is actuated, switch K15S2 moves to an open contact, removing the ground connection form coil 160 to terminal 173, thereby deactuating relay K11. Switch K11S1 is thereby moved to provide a connection between terminal 175 and the ground side of coil 158 of relay K10, thereby actuating relay K10. A ground connection is provided at terminal 175 by a missile on the inboard launcher; thus, there will be a ground connection to actuate relay K10 (when relay K11 is deactuated by actuation of relay K15 when reject switch S4 is closed) when a missile is present on the inboard launcher. Actuation of relay K10 provides, through switch K10S2, a ground connection between coil 162 of relay K12 and terminal 175, thereby actuating relay K12.

When relay K12 is actuated, switch K12S4 provides a current path from terminal 176 to terminal 190, switch K12S3 from terminal 178 to terminal 181, switch K12S2 from terminal 182 to terminal 185 and switch K12S1 from terminal 174 to terminal 192. Thus, actuation of relay K12 by closing reject switch S4 serves to change the connections of the fire, audio and uncage input terminals 176, 178 and 182, respectively, from the outboard to the inboard launcher terminals. This is also accomplished by removing the ground connection at terminal 173 when the outboard missile is fired, which deactuates relay K11. As explained above, deactuating relay K11 actuates relay K10, thereby actuating relay K12 and changing the fire, audio and uncage connections from outboard to inboard launcher.

When missiles are present at both positions, closing switch S3 to provide a "fire" signal to terminal 194 of the outboard launcher, also provides power to coil 196, actuating relay K16. Switch K16S1 is thereby moved from an open contact to provide a ground connection for coil 160, through switch K15S2, to common ground terminal 152. Thus, although the original ground connection for coil 160 at terminal 173 is removed when the outboard missile leaves the launcher, the ground connection provided by relay K16 maintains relay K11 actuated, so that relays K10 and K12 remain deactuated. Relay K16 is deactuated when power is removed from coil 196 by opening switch S3, i.e., by releasing the "fire" button. Therefore, only after the fire button is released will relay K11 be deactuated, allowing relays K10 and K12 to actuate, transferring the connections from outboard to inboard launcher terminals and preventing the firing of both missiles with a single depression of the "fire" button.

When the ground connection is removed from coil 170 of relay K13 at both terminals 173 and 175, after both missiles have been either fired or rejected, relay K13 is deactuated, providing a ground connection from terminal 168 through switch K13S1 to terminal 152. This ground connection indicates that both launchers are empty. The system also preferably includes a captive or safety switch (not shown) which locks the control circuits open to prevent firing during training runs or while the equipment is on the ground.

From the foregoing it may be seen that the objects of the invention are effectively and efficiently attained through both mechanical and electrical modifications to provide air-to-air missile capabilities in an existing military aircraft designed and built to carry and deploy only air-to-ground weapons. The hardware innovations include a box-like enclosure which carries a conventional air-to-air missile launcher on one or both sides and also contains the circuitry for connecting the missiles with electrical power and control signals, while being suspended from the standard pylon bomb hooks. The electrical modifications comprise, in addition to the control circuitry in the suspended launcher mounting means, a left/right select switch, an air/ground weapons select switch and an electrical interface unit having relays responsive to the selected positions of the two switches.

We claim:

1. In a military aircraft having at least ony pylon permanently connected to each wing, said pylons each having a pair of spaced hooks for suspension mounting of conventional air-to-ground weapons, said aircraft further having an electrical system including a power supply, a weapons control network adapted to launch or reject said air-to-ground weapons in response to signals from said power supply, and a pair of selectively operable switches for connecting said signals to said control network to release and reject, respectively, a weapon connected to said network, the combination comprising:

(a) a mounting member having a pair of spaced lugs adapted for engagement by said spaced hooks, thereby suspending said mounting member from one of said pylons, one of said members being suspended from at least one of said pylons;

(b) a pair of missile launchers fixedly connected to inboard and outboard sides, respectively, of said mounting member, each of said launchers being adapted to carry a conventional air-to-air missile;

(c) means electrically connecting a first of said launchers to said weapons control network for selective launching or rejecting of a missile carried by said first launcher in response to a first selective closing of one of said first and second switches, respectively; and (d) relay means operable in response to said first closing of one of said first and second switches to electrically connect the second of said launchers to said weapons control system for selective launching and rejecting of a missile carried by said second launcher in response to a second selective closing of one of said first and second switches, respectively.

2. The invention according to claim 1 wherein said mounting member comprises a box-like enclosure containing said relay means.

3. The invention according to claim 1 wherein one of said mounting members is suspended from one of a first and a second of said pylons, and further including a selectively operable third switch for connecting said weapons release network to the relay means of a mounting member suspended from said first pylon when in a first position, and to a mounting member suspended from said second pylon when in a second position.

4. The invention according to claim 3 wherein said third switch is so located in said aircraft as to be inaccessible when said aircraft is in flight, whereby said third switch is selectively positioned prior to take-off of said aircraft.

5. The invention according to claim 1 wherein said aircraft, in addition to said air-to-air missiles, carries a plurality of conventional air-to-ground weapons and further includes selector means actuable to connect only one of said air-to-air missiles and said air-to-ground weapons to said weapons control network for selective launching and rejecting in response to selective closing of said first and second switches.

6. The invention according to claim 1 wherein said relay means are openable by removal of a ground connection from a coil thereof in response to said first closing of one of said first and second switches.

7. The invention according to claim 6 wherein said ground connection is provided by the missile carried by said first launcher.

* * * * *